US009773611B2

(12) United States Patent
Kim et al.

(10) Patent No.: US 9,773,611 B2
(45) Date of Patent: Sep. 26, 2017

(54) CHIP ELECTRONIC COMPONENT AND MANUFACTURING METHOD THEREOF

(71) Applicant: SAMSUNG ELECTRO-MECHANICS CO., LTD., Suwon (KR)

(72) Inventors: Sung Hyun Kim, Suwon (KR); Myoung Soon Park, Suwon (KR); Sung Hee Kim, Suwon (KR); Tae Young Kim, Suwon (KR); Hye Yeon Cha, Suwon (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/516,151

(22) Filed: Oct. 16, 2014

(65) Prior Publication Data

US 2015/0109088 A1 Apr. 23, 2015

(30) Foreign Application Priority Data

Oct. 22, 2013 (KR) ..... 10-2013-0126137
Jul. 18, 2014 (KR) ..... 10-2014-0090841

(51) Int. Cl.
*H01F 5/00* (2006.01)
*H01F 27/28* (2006.01)
(Continued)

(52) U.S. Cl.
CPC ..... *H01F 41/12* (2013.01); *H01F 17/0013* (2013.01); *H01F 2017/0066* (2013.01); *H01F 2017/048* (2013.01)

(58) Field of Classification Search
CPC ..... H01F 41/02; H01F 41/12; H01F 27/2804; H01F 17/0013; H01F 2017/048; H01F 2017/0066
(Continued)

(56) References Cited

U.S. PATENT DOCUMENTS 6,609,009 B1 8/2003 Kiyosue et al.
6,859,994 B2 * 3/2005 Oshima ..... H01F 41/005 156/169
(Continued)

FOREIGN PATENT DOCUMENTS

CN 1271948 A 11/2000
CN 101814361 A 8/2010
(Continued)

OTHER PUBLICATIONS

Office Action issued in Korean Application No. 10-2014-0090841 dated May 15, 2015.
(Continued)

*Primary Examiner* — Mangtin Lian
(74) *Attorney, Agent, or Firm* — McDermott Will & Emery LLP

(57) ABSTRACT

A chip electronic component may include: a magnetic body having a coil conductive pattern part embedded therein; and an oxide insulating film formed on a surface of the coil conductive pattern part. Even in the case that the insulating film is formed to be thinner than an insulating film, it may prevent the coil conductive pattern part from being exposed, whereby a magnetic material and the coil conductive pattern part may not contact each other. Therefore, a waveform defect may be prevented at a high frequency.

24 Claims, 7 Drawing Sheets

(51) Int. Cl.

| | |
|---|---|
| ***B29C 65/00*** | (2006.01) |
| ***H01B 13/00*** | (2006.01) |
| ***H01F 7/06*** | (2006.01) |
| ***H01F 41/12*** | (2006.01) |
| ***H01F 17/00*** | (2006.01) |
| *H01F 17/04* | (2006.01) |

(58) Field of Classification Search
USPC ..... 336/200, 223, 233; 156/277, 169; 216/13; 29/602.1
See application file for complete search history.

(56) References Cited

U.S. PATENT DOCUMENTS

| | | | | |
|---|---|---|---|---|
| 2001/0017420 | A1* | 8/2001 | Iwao | H01F 17/0013 257/758 |
| 2002/0101683 | A1* | 8/2002 | Katakura | G11B 5/17 360/123.34 |
| 2003/0151849 | A1* | 8/2003 | Sasaki | G11B 5/17 360/123.28 |
| 2006/0214759 | A1 | 9/2006 | Kawarai | |
| 2012/0126926 | A1* | 5/2012 | Kroener | H01F 27/2804 336/199 |
| 2013/0249662 | A1* | 9/2013 | Tonoyama | H01F 27/255 336/200 |
| 2013/0249664 | A1 | 9/2013 | Tonoyama et al. | |
| 2014/0062636 | A1* | 3/2014 | Yang | H01F 17/04 336/83 |

FOREIGN PATENT DOCUMENTS

| | | | |
|---|---|---|---|
| JP | 58-098907 | A | 6/1983 |
| JP | 03-270107 | A | 12/1991 |
| JP | 06-036934 | A | 2/1994 |
| JP | 60-254714 | A | 12/1995 |
| JP | 2001-015341 | A | 1/2001 |
| JP | 2002-151332 | A | 5/2002 |
| JP | 2005-166874 | A | 6/2005 |
| JP | 2006-024677 | A | 1/2006 |
| JP | 2006-253320 | A | 9/2006 |
| JP | 2006-278484 | A | 10/2006 |
| JP | 2006-303405 | A | 11/2006 |
| JP | 2006-310716 | A | 11/2006 |
| JP | 2008-166390 | A | 7/2008 |
| JP | 2010-165964 | A | 7/2010 |
| JP | 2013-201374 | | 10/2013 |
| KR | 05-006832 | | 1/1993 |
| KR | 2005-210010 | | 8/2005 |
| KR | 2008-166455 | | 7/2008 |
| SE | 423944 | B | 6/1982 |

OTHER PUBLICATIONS

Japanese Office Action dated Sep. 8, 2015, issued in corresponding Japanese Patent Application No. 2014-210511. (w/ English translation).
Chinese Office Action dated Jun. 30, 2016, issued in Chinese Patent Application No. 201410566473.8. (w/ English translation).
Chinese Office Action dated Mar. 27, 2017, issued in Chinese Patent Application No. 201410566473.8 (w/ English translation).

* cited by examiner

CHIP ELECTRONIC COMPONENT AND MANUFACTURING METHOD THEREOF

CROSS-REFERENCE TO RELATED APPLICATIONS

This application claims the foreign priority benefit of Korean Patent Application No. 10-2013-0126137 filed on Oct. 22, 2013 and 10-2014-0090841 filed on Jul. 18, 2014, with the Korean Intellectual Property Office, the disclosures of which are incorporated herein by reference.

BACKGROUND

Field

The present disclosure relates to a chip electronic component and a manufacturing method thereof.

An inductor, a chip electronic component, is a representative passive element configuring an electronic circuit together with a resistor and a capacitor to remove noise.

A thin film inductor is manufactured by forming a coil conductive pattern part by a plating process and stacking, compressing, and hardening magnetic material sheets formed of a mixture of a magnetic powder and a resin.

Here, in order to prevent a contact between the coil conductive pattern part and the magnetic material, an insulating film is formed on a surface of the coil conductive pattern part.

SUMMARY

An exemplary embodiment may provide a chip electronic component including an insulating film that is thinner than an insulating film according to the related art and is capable of effectively preventing a contact with a magnetic material, and a manufacturing method thereof.

According to an exemplary embodiment, a chip electronic component having an oxide insulating film formed on a surface of the coil conductive pattern part may be provided, wherein the oxide insulating film is formed of a metallic oxide containing at least one metal forming the coil conductive pattern part.

BRIEF DESCRIPTION OF THE DRAWINGS

The above and other aspects, features and advantages in the present disclosure will be more clearly understood from the following detailed description taken in conjunction with the accompanying drawings, in which.

DESCRIPTION OF EMBODIMENTS

Figure 1:
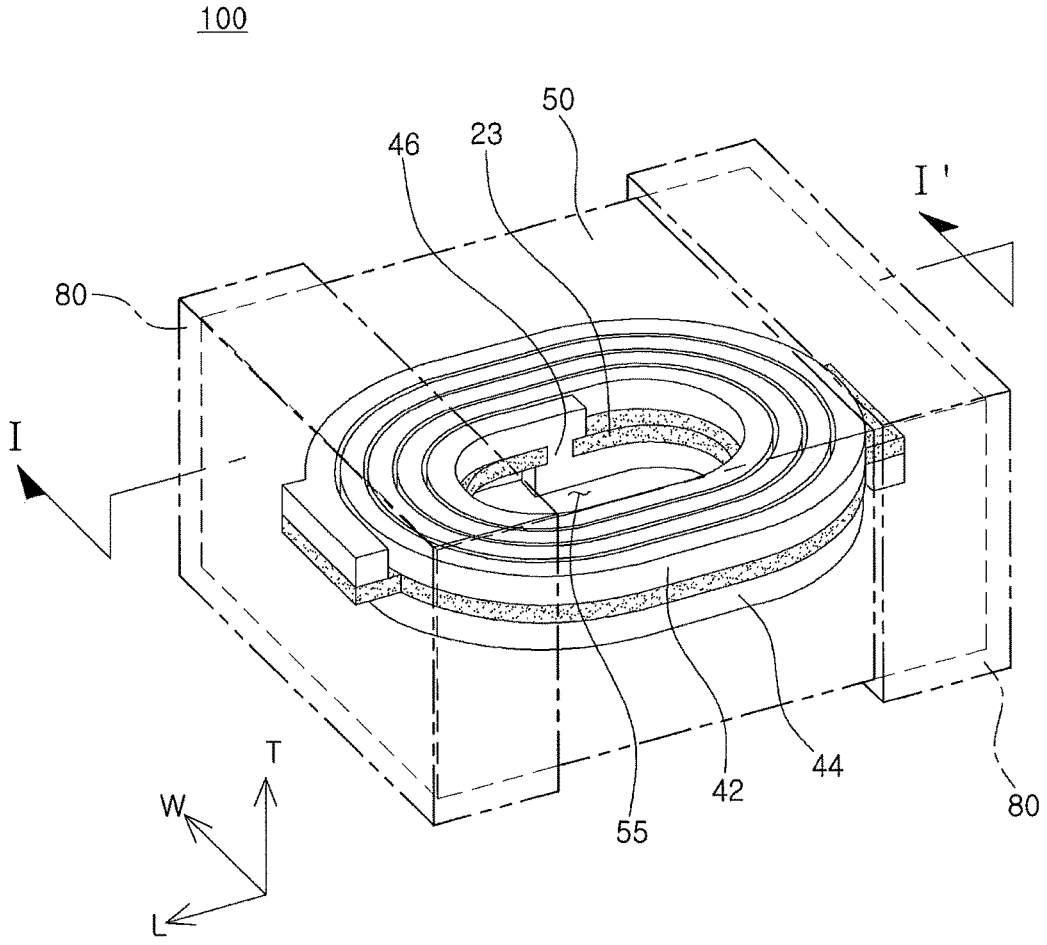
FIG. 1 is a schematic perspective view of a chip electronic component having a coil conductive pattern part according to an exemplary embodiment.

Exemplary embodiments will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Hereinafter, a chip electronic component according to an exemplary embodiment, particularly, a thin film inductor will be described. However, the invention is not limited thereto.

Figure 2:
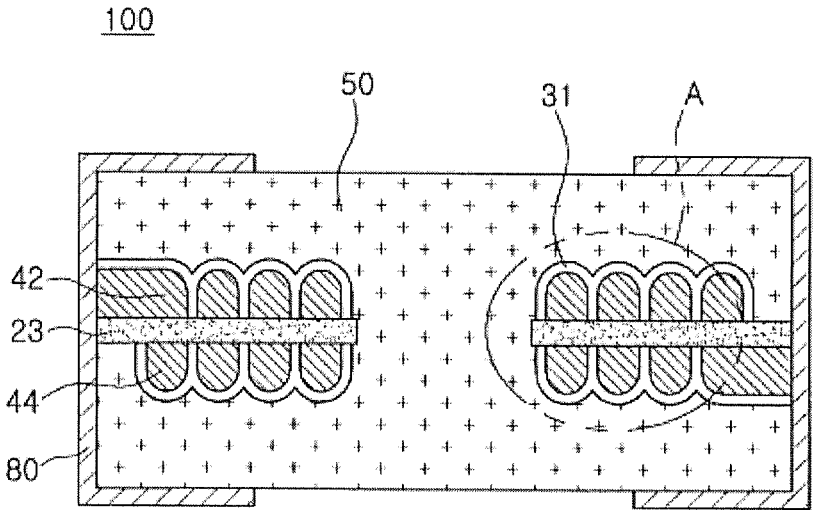
FIG. 2 is a cross-sectional view taken along line I-I' of FIG. 1.

FIG. 1 is a schematic perspective view of a chip electronic component having a coil conductive pattern part according to an exemplary embodiment; and FIG. 2 is a cross-sectional view taken along line I-I' of FIG. 1.

Referring to FIGS. 1 and 2, as an example of a chip electronic component, a thin film inductor 100 used in a power line of a power supply circuit is disclosed.

The thin film inductor 100 according to the exemplary embodiment may include a magnetic body 50, coil conductive pattern parts 42 and 44 embedded in the magnetic body 50, and external electrodes 80 formed on outer surfaces of the magnetic body 50 and connected to the coil conductive pattern parts 42 and 44.

The magnetic body 50 may form an exterior appearance of the thin film inductor 100 and may be formed of any material that exhibits magnetic properties. For example, the magnetic body 50 may be formed by filling ferrite or a metal based soft magnetic material.

The ferrite may contain ferrite known in the art, such as Mn—Zn based ferrite, Ni—Zn based ferrite, Ni—Zn—Cu based ferrite, Mn—Mg based ferrite, Ba based ferrite, Li based ferrite, or the like.

The metal based soft magnetic material may be an alloy containing at least one selected from the group consisting of Fe, Si, Cr, Al, and Ni. For example, the metal based soft magnetic material may contain Fe—Si—B—Cr based amorphous metal particles, but is not limited thereto.

The metal based soft magnetic material may have a particle size of about 0.1 μm to about 30 μm, and may be dispersed in a polymer such as epoxy resin, polyimide, or the like.

The magnetic body 50 may have a hexahedral shape. Directions of a hexahedron will be defined in order to clearly define an exemplary embodiment. L, W and T shown in FIG. 1 refer to a length direction, a width direction, and a thickness direction, respectively.

An insulating substrate 23 formed in the magnetic body 50 may be, for example, a polypropylene glycol (PPG) substrate, a ferrite substrate, a metal based soft magnetic substrate, or the like.

The insulating substrate 23 may have a through hole formed in a central portion thereof, wherein the hole may be filled with a magnetic material such as ferrite, a metal based soft magnetic material, or the like, to form a core part 55. The core part 55 filled with the magnetic material may increase an inductance L.

The insulating substrate 23 may have the coil conductive pattern parts 42 and 44 formed on one surface and the other surface thereof, respectively, wherein the coil conductive pattern parts 42 and 44 have coil shaped patterns.

The coil conductive pattern parts 42 and 44 may include coil patterns having a spiral shape, and the coil conductive pattern parts 42 and 44 formed on one surface and the other surface of the insulating substrate 23, respectively, may be electrically connected to each other through a via electrode 46 formed in the insulating substrate 23.

The coil conductive pattern parts 42 and 44 and the via electrode 46 may be formed of a metal having excellent electrical conductivity, for example, silver (Ag), palladium (Pd), aluminum (Al), nickel (Ni), titanium (Ti), gold (Au), copper (Cu), platinum (Pt), or an alloy thereof.

Figure 3:
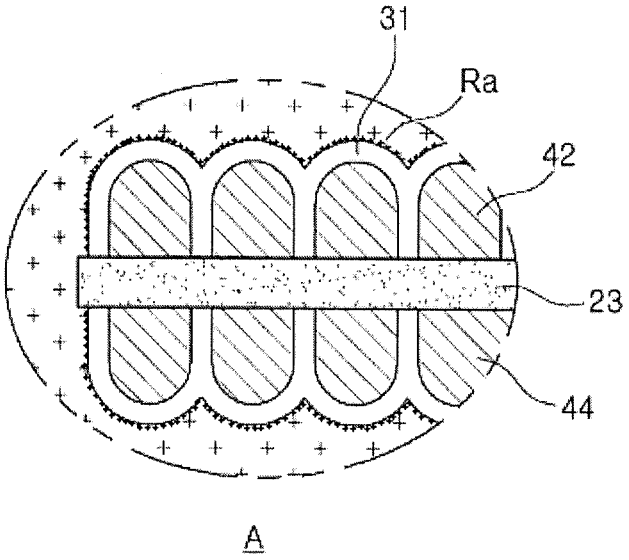
FIG. 3 is an enlarged schematic view of an example of part A of FIG. 2.

FIG. 3 is an enlarged schematic view of an example of part A of FIG. 2.

Referring to FIG. 3, the coil conductive pattern parts 42 and 44 may have an oxide insulating film 31 formed on surfaces thereof.

A surface of a coil conductive pattern part can be coated with a polymer material to form an insulating film. However, there may be limitations in decreasing a thickness of the insulating film formed as described above. For example, in a case in which the thickness of the insulating film is decreased to form a thin insulating film, the coil conductive pattern part may partially be exposed. When the coil conductive pattern part is exposed, a leakage current may be generated. Therefore, although an inductance is normal at 1 MHz, it may rapidly be lowered at high frequency, resulting in waveform defects.

Therefore, in the exemplary embodiment, the oxide insulating film 31 formed of a metal oxide may be formed on the surfaces of the coil conductive pattern parts 42 and 44, such that a thin insulating film is uniformly formed without a portion in which the insulating film is not formed.

The oxide insulating film 31 may be formed of a metallic oxide having at least one metal contained in the coil conductive pattern parts 42 and 44. The oxide insulating film 31 may be formed by oxidizing the coil conductive pattern parts 42 and 44 in a high temperature or high humidity environment or oxidizing the coil conductive pattern parts 42 and 44 through chemical etching.

A surface roughness Ra of the oxide insulating film 31 may be about 0.6 μm to about 0.8 μm.

When the oxide insulating film 31 is formed through chemical etching, or the like, the surface roughness Ra of the oxide insulating film 31 may be increased to about 0.6 μm to about 0.8 μm. A surface area is increased due to the increased surface roughness Ra, whereby interface adhesion between the oxide insulating film 31 and a second insulating film formed on the oxide insulating film 31 may be improved and reliability may be secured.

The oxide insulating film 31 may have various shapes such as an acicular structure, a vine structure, or the like.

The oxide insulating film 31 may be formed to have a thickness of about 0.5 μm to about 2.5 μm.

In the case in which the thickness of the oxide insulating film 31 is less than about 0.5 μm, the oxide insulating film may be damaged, resulting in the generation of a leakage current and the occurrence of a waveform defect that an inductance is decreased at high frequency. In the case in which the thickness of the oxide insulating film 31 exceeds about 2.5 μm, inductance characteristics may deteriorate.

Figure 4:
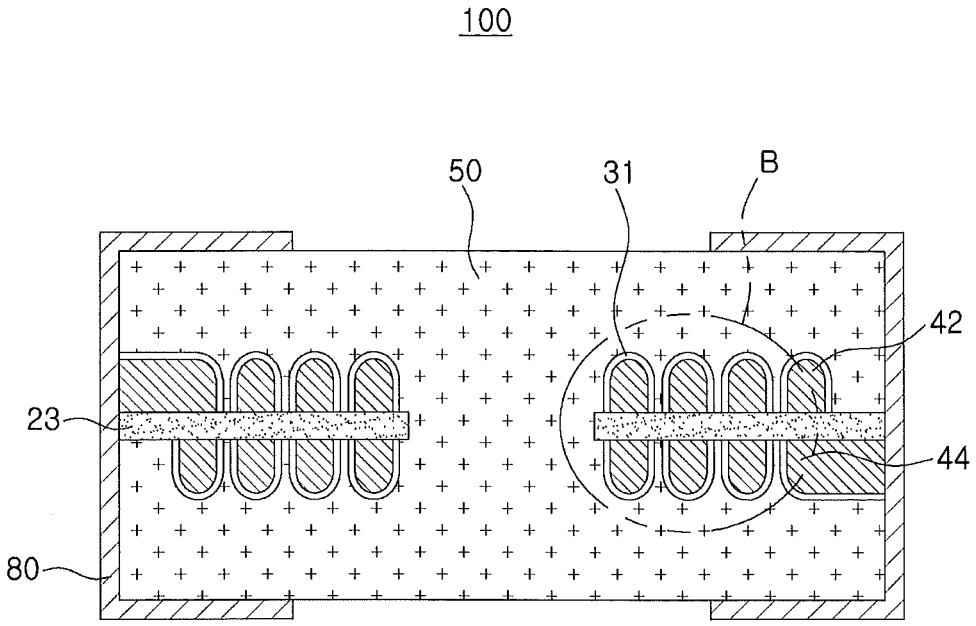
FIG. 4 is a cross-sectional view of a chip electronic component according to an exemplary embodiment in a length-thickness (L-T) direction.
Figure 5:
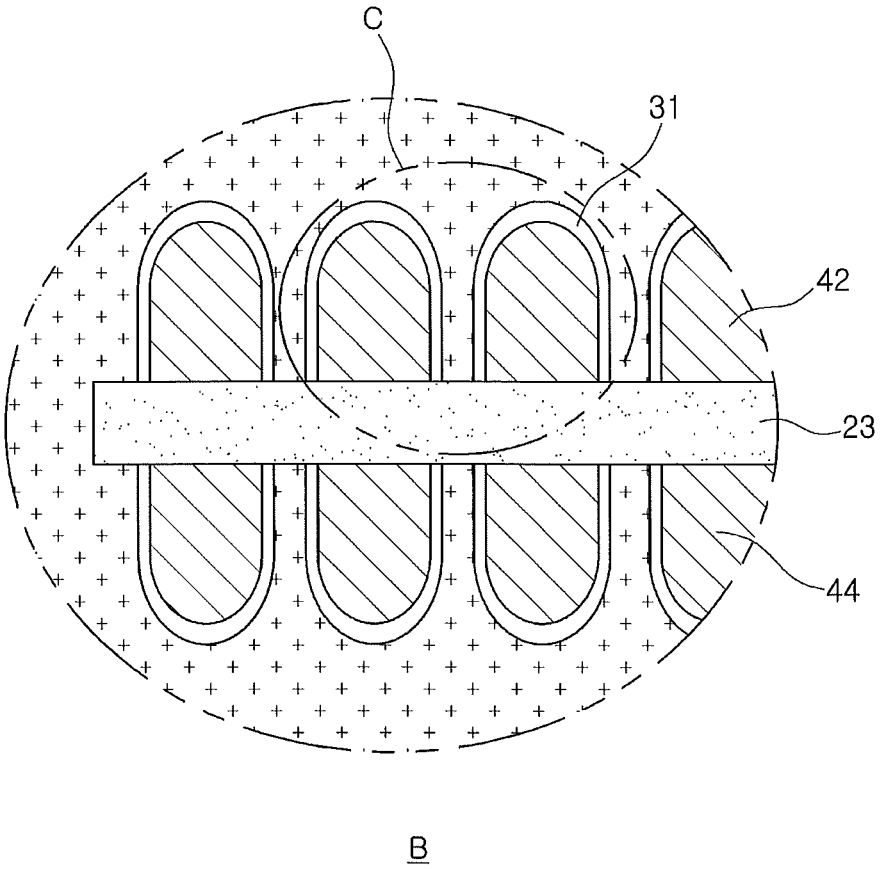
FIG. 5 is an enlarged schematic view of an example of part B of FIG. 4.

FIG. 4 is a cross-sectional view of a chip electronic component according to an exemplary embodiment in a length-thickness (L-T) direction; and FIG. 5 is an enlarged schematic view of an example of part B of FIG. 4.

Referring to FIGS. 4 and 5, a region between adjacent patterns of the coil conductive pattern parts 42 and 44 on which the oxide insulating film 31 is formed may be filled with a magnetic material.

Since the oxide insulating film 31 may be formed to be significantly thin while corresponding to the shapes of the surfaces of the coil conductive pattern parts 42 and 44, a space may be formed in the region between the adjacent patterns. The space may be filled with the magnetic material, such that a volume of the magnetic material may be increased, and thus, an inductance may be increased by the increased volume of the magnetic material.

Figure 6:
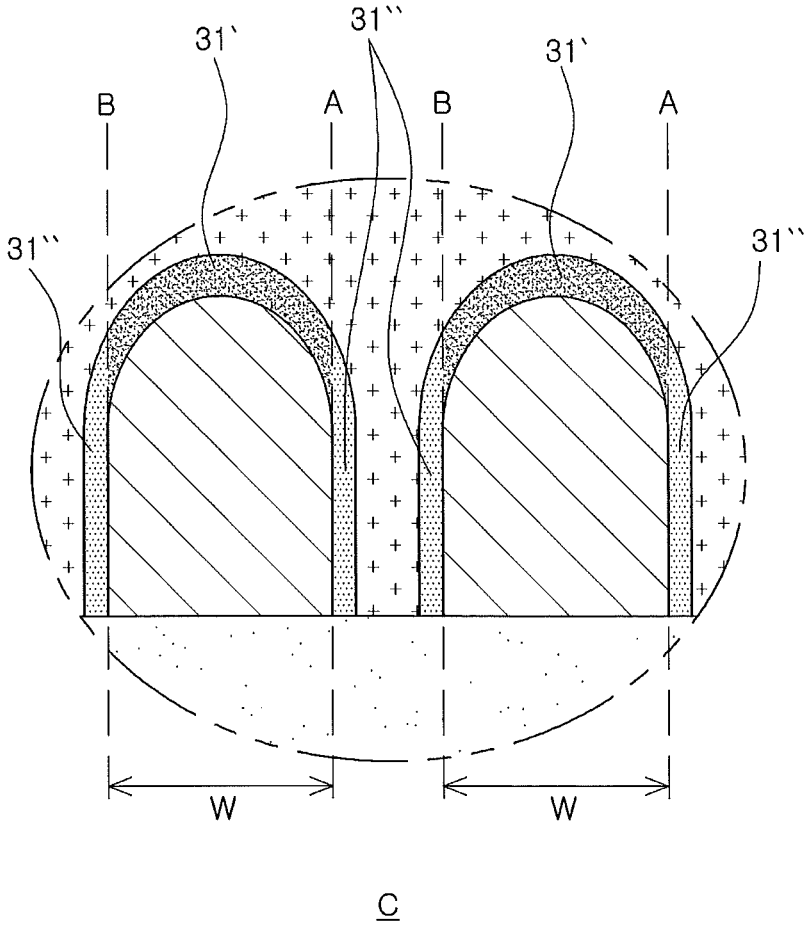
FIG. 6 is an enlarged schematic view of an example of part C of FIG. 5.

FIG. 6 is an enlarged schematic view of an example of part C of FIG. 5.

Referring to FIG. 6, an average thickness of an oxide insulating film 31' formed on upper surfaces of the coil conductive pattern parts 42 and 44 may be thicker than an average thickness of an oxide insulating film 31" formed on side surfaces of the coil conductive pattern parts 42 and 44.

The upper surfaces of the coil conductive pattern parts 42 and 44 may refer to upper surfaces of coil patterns based on virtual lines A and B extended from edges of the coil patterns defining the widths w of the coil patterns, and the side surfaces of the coil conductive pattern parts 42 and 44 may refer to side surfaces of the coil patterns based on the virtual lines A and B.

Since the oxide insulating film 31' formed on the upper surfaces of the coil conductive pattern parts 42 and 44 is relatively vulnerable to external force in a process of compressing the magnetic material sheets, or the like, the thickness of the oxide insulating film 31' may be thicker than the thickness of the oxide insulating film 31" formed on the side surfaces of the coil conductive pattern parts 42 and 44 to thereby secure insulation properties.

Further, in order to prevent a decrease in the area of the coil patterns and an increase in direct current (DC) resistance (Rdc) due to an increase in the thickness of the oxide insulating film, the oxide insulating film 31" formed on the side surfaces of the coil conductive pattern parts 42 and 44 relatively less vulnerable to the external force may be formed to be thinner than the oxide insulating film 31' formed on the upper surfaces of the coil conductive pattern parts 42 and 44.

That is, the average thickness of the oxide insulating film 31' formed on the upper surfaces of the coil conductive pattern parts 42 and 44 is thicker than the average thickness of the oxide insulating film 31" formed on the side surfaces of the coil conductive pattern parts 42 and 44, and thus, excellent insulation properties may be secured and DC resistance (Rdc) may be decreased.

The thickness of the oxide insulating film 31' formed on the upper surfaces of the coil conductive pattern parts 42 and 44 may be about 1.8 μm to about 2.5 μm.

In the case in which the thickness of the oxide insulating film 31' is less than about 1.8 μm, the oxide insulating film may be damaged, resulting in the generation of a leakage current and the occurrence of a waveform defect that an inductance is decreased at high frequency. In the case in which the thickness of the oxide insulating film 31' exceeds about 2.5 μm, inductance characteristics may deteriorate.

The thickness of the oxide insulating film 31" formed on the side surfaces of the coil conductive pattern parts 42 and 44 may be about 0.8 μm to about 1.8 μm.

In the case in which the thickness of the oxide insulating film 31" is less than about 0.8 μm, a leakage current may be generated and a waveform defect that an inductance is decreased at a high frequency may occur. In the case in which the thickness of the oxide insulating film 31" exceeds about 1.8 μm, the area of the coil patterns may be decreased, resulting in an increase in DC resistance (Rdc).

In addition, a surface roughness Ra of the oxide insulating film 31' formed on the upper surfaces of the coil conductive pattern parts 42 and 44 may be greater than that of the oxide insulating film 31" formed on the side surfaces of the coil conductive pattern parts 42 and 44.

Figure 7:
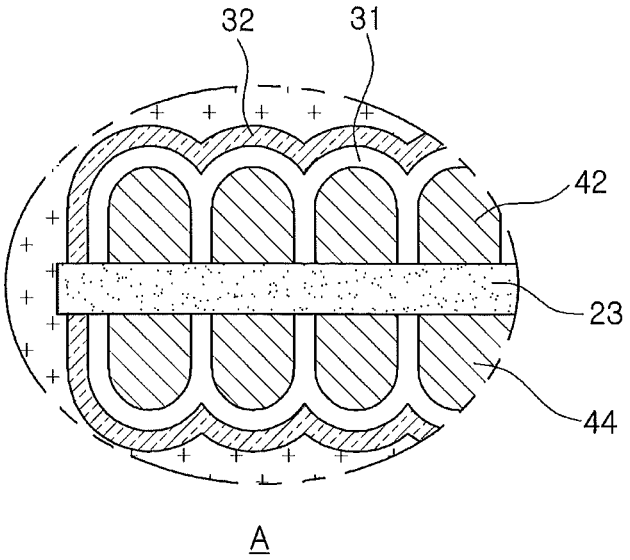
FIG. 7 is an enlarged schematic view of an example of part A of FIG. 2.
Figure 8:
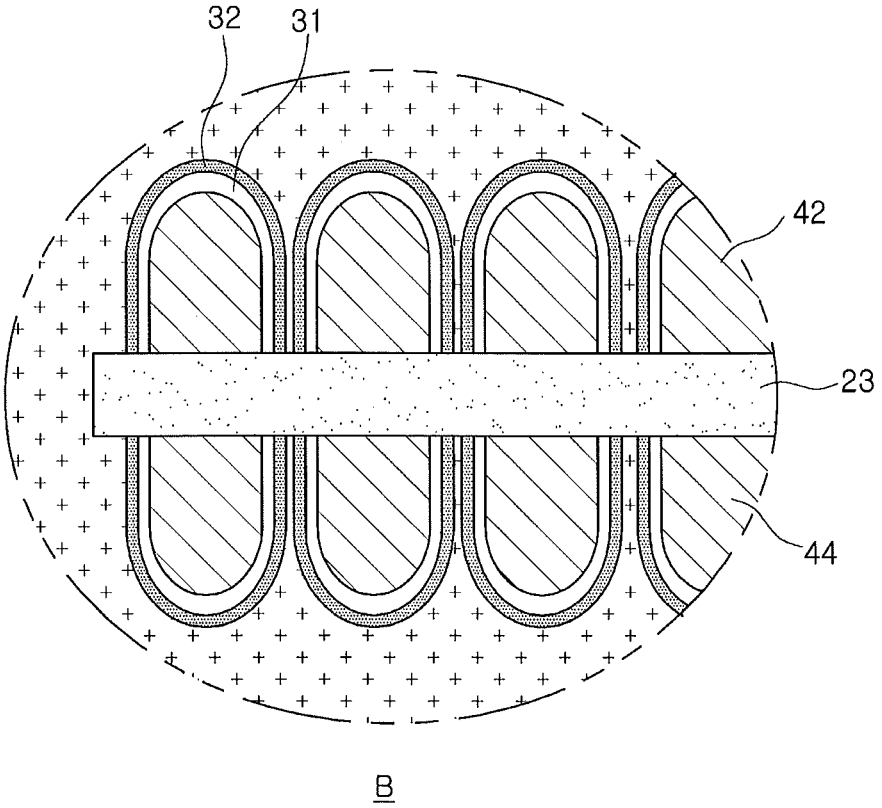
FIG. 8 is an enlarged schematic view of an example of part B of FIG. 4.

FIG. 7 is an enlarged schematic view of an example of part A of FIG. 2; and FIG. 8 is an enlarged schematic view of an example of part B of FIG. 4.

Referring to FIG. 7, a polymer insulating film 32 may be formed to coat the oxide insulating film 31.

The polymer insulating film 32 may be formed by a method such as a screen printing method, an exposure and development method of a photoresist (PR), a spraying method, a dipping method, or the like.

The polymer insulating film 32 may be formed of any material that may form a thin insulating film on the oxide insulating film 31, for example, an epoxy based resin, a polyimide resin, a phenoxy resin, a polysulfone resin, a polycarbonate resin, or the like.

The polymer insulating film 32 may be formed to have a thickness of about 1 μm to about 3 μm.

In the case in which the thickness of the polymer insulating film 32 is less than about 1 μm, the polymer insulating film may be damaged, such that a leakage current may be generated and a waveform defect that an inductance is decreased at a high frequency or a short-circuit defect between the coil patterns may occur. In the case in which the thickness of the polymer insulating film 32 exceeds about 3 μm, inductance characteristics may deteriorate.

An average thickness ratio between the oxide insulating film 31 and the polymer insulating film 32 may be about 1:1.2 to about 1:3.

By forming a double insulating film structure of the oxide insulating film 31 and the polymer insulating film 32 to satisfy the above-mentioned average thickness ratio, the generation of the leakage current may be prevented and the waveform defect and the short-circuit defect may be decreased, and by forming the insulating films to be thin, excellent inductance characteristics may be secured.

Referring to FIG. 8, the shape of a surface of the polymer insulating film 32 may be formed to correspond to the shape of the surfaces of the coil conductive pattern parts 42 and 44.

This means that the polymer insulating film 32 is thinly coated on the surfaces of the coil conductive pattern parts 42 and 44, as illustrated in FIG. 8.

When the surface of the polymer insulating film 32 is formed to be thin while corresponding to the shapes of the surfaces of the coil conductive pattern parts 42 and 44, a space may be formed in a region between the coil patterns. The space may be filled with a magnetic material, such that a volume of the magnetic material may be increased, and thus, an inductance may be increased by the increased volume of the magnetic material.

Figure 9:
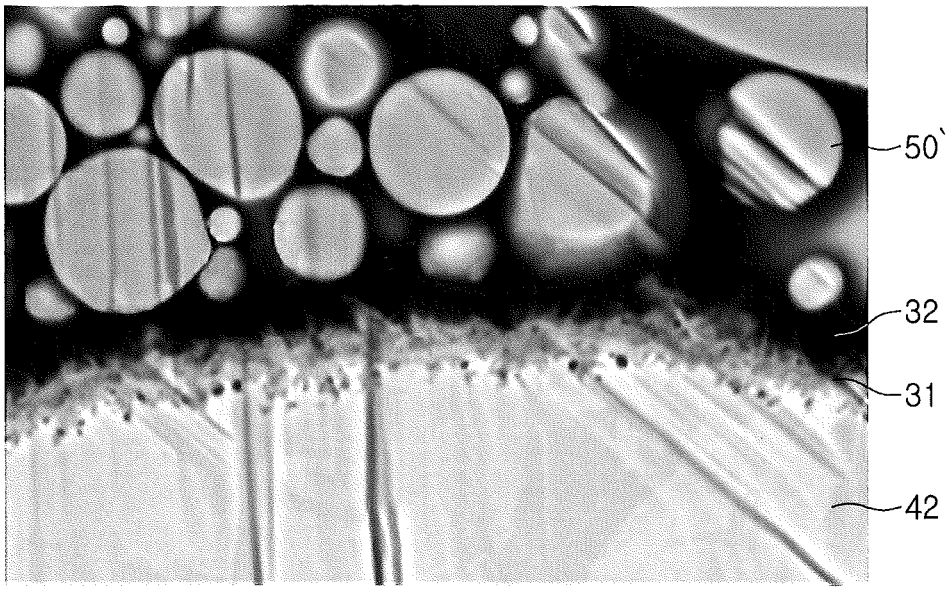
FIG. 9 is an enlarged scanning electron microscope (SEM) photograph of a portion of a coil conductive pattern part on which an insulating film is formed in a chip electronic component according to an exemplary embodiment.

FIG. 9 is an enlarged scanning electron microscope (SEM) photograph of a portion of a coil conductive pattern part on which an insulating film is formed in the chip electronic component according to an exemplary embodiment.

Referring to FIG. 9, it can be seen that the oxide insulating film 31, which is a first insulating film, is formed on the surface of the coil conductive pattern part 42 by oxidizing the surface of the coil conductive pattern part 42, and the polymer insulating film 32, which is a second insulating film, is formed on the oxide insulating film 31.

By forming the insulating film to have the double structure as described above, even in the case that the insulating film is formed to be thin, contact between the coil conductive pattern part and a magnetic material 50' may be prevented and the waveform defect and the short-circuit defect may be decreased.

An end of the coil conductive pattern part 42 formed on one surface of the insulating substrate 23 may be exposed to one end surface of the magnetic body 50 in the length direction thereof, and an end of the coil conductive pattern part 44 formed on the other surface of the insulating substrate 23 may be exposed to the other end surface of the magnetic body 50 in the length direction thereof.

The external electrodes 80 may be formed on both end surfaces of the magnetic body 50 in the length direction thereof so as to be connected to the coil conductive pattern parts 42 and 44 exposed to both end surfaces of the magnetic body 50 in the length direction thereof, respectively.

The external electrodes 80 may be formed of a metal having excellent electrical conductivity, for example, nickel (Ni), copper (Cu), tin (Sn), silver (Ag), or an alloy thereof, etc.

Figure 10:
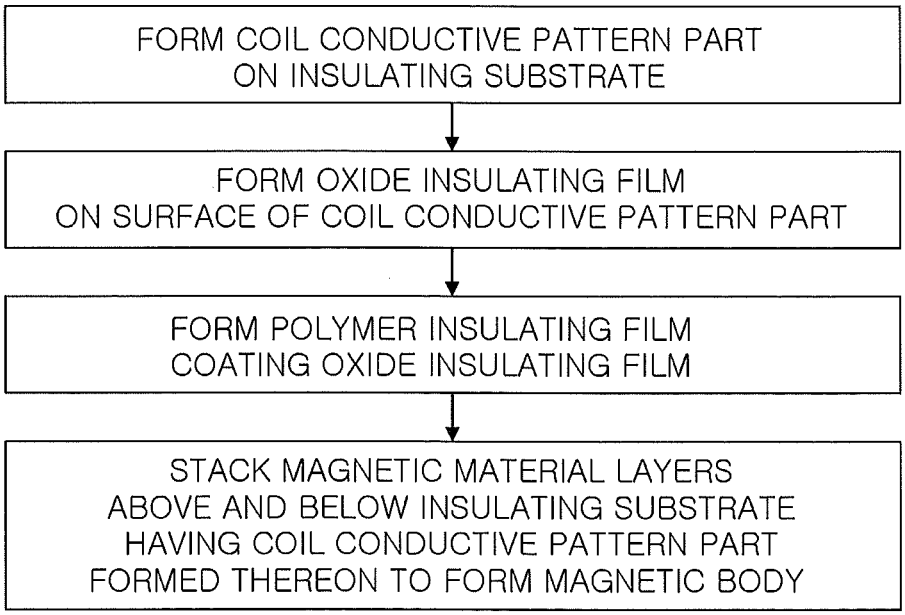
FIG. 10 is a flowchart illustrating a method of manufacturing a chip electronic component according to an exemplary embodiment.

FIG. 10 is a flowchart illustrating a method of manufacturing a chip electronic component according to an exemplary embodiment.

Referring to FIG. 10, the coil conductive pattern parts 42 and 44 may be formed on the insulating substrate 23.

The insulating substrate 23 is not particularly limited, but may be, for example, a printed circuit board (PCB), a ferrite substrate, a metal based soft magnetic substrate, or the like, and may have a thickness of about 40 μm to about 100 μm.

A method of forming the coil conductive pattern parts 42 and 44 may be, for example, an electroplating method, but is not limited thereto.

The coil conductive pattern parts 42 and 44 may be formed of a metal having excellent electrical conductivity, for example, silver (Ag), palladium (Pd), aluminum (Al), nickel (Ni), titanium (Ti), gold (Au), copper (Cu), platinum (Pt), or an alloy thereof.

The hole may be formed in a portion of the insulating substrate 23 and may be filled with a conductive material to form the via electrode 46, and the coil conductive pattern parts 42 and 44 formed on one surface and the other surface of the insulating substrate 23, respectively, may be electrically connected to each other through the via electrode 46.

Drilling, laser processing, sand blasting, punching, or the like, may be performed on a central portion of the insulating substrate 23 to form the hole penetrating through the insulating substrate 23.

Next, the oxide insulating film 31 may be formed on the surfaces of the coil conductive pattern parts 42 and 44.

The oxide insulating film 31 may be formed by oxidizing at least one metal contained in the coil conductive pattern parts 42 and 44.

A method of forming the oxide insulating film 31 by oxidizing the surfaces of the coil conductive pattern parts 42 and 44 is not particularly limited. For example, the oxide insulating film 31 may be formed by oxidizing the coil conductive pattern parts 42 and 44 in a high temperature or high humidity environment or oxidizing the coil conductive pattern parts 42 and 44 through chemical etching.

In a case in which the oxide insulating film 31 is formed through chemical etching, a surface roughness Ra of the oxide insulating film 31 may be improved.

The surface roughness Ra of the oxide insulating film 31 may be about 0.6 μm to about 0.8 μm.

When the oxide insulating film 31 is formed through the chemical etching, or the like, the surface roughness Ra of the oxide insulating film 31 may be increased to about 0.6 μm to about 0.8 μm. When a surface area is increased due to the increased surface roughness Ra, whereby interface adhesion between the oxide insulating film 31 and a second insulating film formed on the oxide insulating film 31 may be improved and reliability may be secured.

The oxide insulating film 31 may have various shapes such as an acicular structure, a vine structure, or the like.

In the case of forming the oxide insulating film 31 by oxidizing the coil conductive pattern parts 42 and 44 in the high temperature environment, a cleaning effect between the coil patterns of the coil conductive pattern parts 42 and 44 may be excellent.

The oxide insulating film 31 may be formed to have a thickness of about 0.5 μm to about 2.5 μm.

In the case in which the thickness of the oxide insulating film 31 is less than about 0.5 μm, the oxide insulating film may be damaged, resulting in the generation of a leakage current and the occurrence of a waveform defect that an inductance is decreased at a high frequency. In the case in which the thickness of the oxide insulating film 31 exceeds about 2.5 μm, inductance characteristics may deteriorate.

The concentration, oxidation temperature, time, and the like, of an oxide layer forming solution may be controlled at the time of forming the oxide insulating film 31 to adjust the thickness of the oxide insulating film 31.

The average thickness of the oxide insulating film 31' formed on the upper surfaces of the coil conductive pattern parts 42 and 44 may be thicker than the average thickness of the oxide insulating film 31" formed on the side surfaces of the coil conductive pattern parts 42 and 44.

The average thickness of the oxide insulating film 31' formed on the upper surfaces of the coil conductive pattern parts 42 and 44 is thicker than the average thickness of the oxide insulating film 31" formed on the side surfaces of the coil conductive pattern parts 42 and 44, such that excellent insulation properties may be secured and DC resistance (Rdc) may be decreased.

The thickness of the oxide insulating film 31' formed on the upper surfaces of the coil conductive pattern parts 42 and 44 may be about 1.8 μm to about 2.5 μm.

In the case in which the thickness of the oxide insulating film 31' is less than about 1.8 μm, the oxide insulating film may be damaged, resulting in the generation of a leakage current and the occurrence of a waveform defect that an inductance is decreased at a high frequency. In the case in which the thickness of the oxide insulating film 31' exceeds about 2.5 μm, inductance characteristics may deteriorate.

The thickness of the oxide insulating film 31" formed on the side surfaces of the coil conductive pattern parts 42 and 44 may be about 0.8 μm to about 1.8 μm.

In the case in which the thickness of the oxide insulating film 31" is less than about 0.8 μm, a leakage current may be generated and a waveform defect that an inductance is decreased at a high frequency may occur. In the case in which the thickness of the oxide insulating film 31" exceeds about 1.8 μm, the area of the coil patterns may be decreased, resulting in an increase in DC resistance (Rdc).

Next, the polymer insulating film 32 may be formed to coat the oxide insulating film 31.

The polymer insulating film 32 may be formed by a method well-known in the art such as a screen printing method, an exposure and development method of a photoresist (PR), a spraying method, a dipping method, or the like.

The polymer insulating film 32 may be formed of any material that may form a thin insulating film on the oxide insulating film 31, for example, a photoresist (PR), an epoxy based resin, a polyimide resin, a phenoxy resin, a polysulfone resin, a polycarbonate resin, or the like.

The polymer insulating film 32 may be formed to have a thickness of about 1 μm to about 3 μm.

In the case in which the thickness of the polymer insulating film 32 is less than about 1 μm, the polymer insulating film may be damaged, such that a leakage current may be generated and a waveform defect that an inductance is decreased at a high frequency or a short-circuit defect between the coil patterns may occur. In the case in which the thickness of the polymer insulating film 32 exceeds about 3 μm, inductance characteristics may deteriorate.

The shape of the surface of the polymer insulating film 32 may be formed to correspond to the shapes of the surfaces of the coil conductive pattern parts 42 and 44.

A method of forming the polymer insulating film 32 is not particularly limited as long as the polymer insulating film 32 may be formed as a thin film while corresponding to the shapes of the surfaces of the coil conductive pattern parts 42 and 44. For example, the polymer insulating film 32 may be formed through a chemical vapor deposition (CVD) method or a dipping method using a low viscosity polymer coating solution.

When the surface of the polymer insulating film 32 is formed to be thin while corresponding to the shapes of the surfaces of the coil conductive pattern parts 42 and 44, a space may be formed in a region between the coil patterns. The space may be filled with a magnetic material, such that a volume of the magnetic material may be increased, and thus, an inductance may be increased by the increased volume of the magnetic material.

By forming the insulating film to have the double structure according to the exemplary embodiment, even in the case that the insulating film is formed to be thin, contact between the coil conductive pattern part and the magnetic material may be prevented and the waveform defect and the short-circuit defect may be decreased.

Next, magnetic material layers may be stacked above and below the insulating substrate 23 having the coil conductive pattern parts 42 and 44 formed thereon, respectively, to form the magnetic body 50.

The magnetic material layers may be stacked on both surfaces of the insulating substrate 23 and be compressed by a laminating method or an isostatic pressing method to form the magnetic body 50. Here, the hole may be filled with the magnetic material to form the core part 55.

In addition, the external electrodes 80 may be formed to be connected to the coil conductive pattern parts 42 and 44 exposed to the end surfaces of the magnetic body 50.

The external electrode 80 may be formed of a paste containing a metal having excellent electrical conductivity, for example, a conductive paste containing nickel (Ni), copper (Cu), tin (Sn), silver (Ag), or an alloy thereof. The external electrodes 80 may be formed by a printing method, a dipping method, or the like, depending on the shape thereof.

A description of features that are the same as those of the chip electronic component according to the previous exemplary embodiment will be omitted.

As set forth above, in the chip electronic component and the manufacturing method thereof according to exemplary embodiments, even in the case that the insulating film thinner than an insulating film according to the related art is formed on the coil conductive pattern parts, it may prevent the coil conductive pattern parts from being exposed, such that the magnetic material and the coil conductive pattern parts may not contact each other. Therefore, the waveform defect may be prevented at high frequency.

While exemplary embodiments have been shown and described above, it will be apparent to those skilled in the art that modifications and variations could be made without departing from the scope of the present invention as defined by the appended claims.

What is claimed is:

1. A chip electronic component comprising:

a magnetic body in which a coil conductive pattern part is embedded;

an oxide insulating film disposed on a surface of the coil conductive pattern part; and a polymer insulating film coating the oxide insulating film, wherein the oxide insulating film has a surface roughness Ra of about 0.6 μm to about 0.8 μm, and wherein the oxide insulating film has a thickness of about 0.5 μm to about 2.5 μm.

2. The chip electronic component of claim 1, wherein the oxide insulating film is formed of a metallic oxide containing at least one metal forming the coil conductive pattern part.

3. The chip electronic component of claim 1, wherein a surface roughness Ra of the oxide insulating film formed on an upper surface of the coil conductive pattern part is greater than a surface roughness of the oxide insulating film formed on a side surface of the coil conductive pattern part.

4. The chip electronic component of claim 1, wherein an average thickness of the oxide insulating film formed on an upper surface of the coil conductive pattern part is greater than an average thickness of the oxide insulating film formed on a side surface of the coil conductive pattern part.

5. The chip electronic component of claim 1, wherein a thickness of the oxide insulating film formed on an upper surface of the coil conductive pattern part has a thickness of about 1.8 μm to about 2.5 μm.

6. The chip electronic component of claim 1, wherein the oxide insulating film formed on a side surface of the coil conductive pattern part has a thickness of about 0.8 μm to about 2 μm.

7. The chip electronic component of claim 1, wherein a shape of a surface of the polymer insulating film corresponds to a shape of the surface of the coil conductive pattern part.

8. The chip electronic component of claim 1, wherein the polymer insulating film has a thickness of about 1 μm to about 3 μm.

9. The chip electronic component of claim 1, wherein an average thickness ratio between the oxide insulating film and the polymer insulating film is 1:1.2 to 1:3.

10. The chip electronic component of claim 1, wherein at least a portion of a region between adjacent patterns of the coil conductive pattern part is filled with a magnetic material.

11. The chip electronic component of claim 1, wherein the oxide insulating film is manufactured by a method comprising:

forming the oxide insulating film by oxidizing the outer layer of the coil.

12. The chip electronic component of claim 11, wherein the oxide insulating film layer is manufactured by a method comprising:

forming the oxide insulating film by exposing the coil in a high temperature or high humidity environment or through chemical etching.

13. A chip electronic component comprising:

a magnetic body including an insulating substrate;

a coil conductive pattern part provided on at least one surface of the insulating substrate;

a first insulating film provided on a surface of the coil conductive pattern part; and a second insulating film coating the first insulating film, wherein the first insulating film has a surface roughness Ra of about 0.6 μm to about 0.8 μm, and wherein the first insulating film has a thickness of about 0.5 μm to about 2.5 μm.

14. The chip electronic component of claim 13, wherein the first insulating film is formed of a metallic oxide having at least one metal contained in the coil conductive pattern part.

15. The chip electronic component of claim 13, wherein the second insulating film contains a polymer, and a shape of a surface of the second insulating film corresponds to a shape of the surface of the coil conductive pattern part.

16. The chip electronic component of claim 13, wherein a surface roughness Ra of the first insulating film formed on an upper surface of the coil conductive pattern part is greater than a surface roughness of the first insulating film formed on a side surface of the coil conductive pattern part.

17. The chip electronic component of claim 13, wherein an average thickness of the first insulating film formed on an upper surface of the coil conductive pattern part is greater than an average thickness of the first insulating film formed on a side surface of the coil conductive pattern part.

18. The chip electronic component of claim 13, wherein at least a portion of a region between adjacent patterns of the coil conductive pattern part is filled with a magnetic material.

19. The chip electronic component of claim 13, wherein the oxide insulating film is manufactured by a method comprising:

forming the oxide insulating film by oxidizing the outer layer of the coil.

20. The chip electronic component of claim 19, wherein the oxide insulating film layer is manufactured by a method comprising:

forming the oxide insulating film by exposing the coil in a high temperature or high humidity environment or through chemical etching.

21. A method of manufacturing a chip electronic component, the method comprising:

forming a coil conductive pattern part on at least one surface of an insulating substrate;

forming an oxide insulating film on a surface of the coil conductive pattern part; and stacking magnetic material layers above and below the insulating substrate having the coil conductive pattern part formed thereon to form a magnetic body, wherein the oxide insulating film is formed to have a surface roughness Ra of about 0.6 μm to about 0.8 μm, and wherein the oxide insulating film is formed to have a thickness of about 0.5 μm to about 2.5 μm.

22. The method of claim 21, further comprising forming a polymer insulating film coating the oxide insulating film.

23. The method of claim 21, wherein the oxide insulating film is formed by oxidizing the surface of the coil conductive pattern part.

24. The method of claim 21, wherein the oxide insulating film formed on an upper surface of the coil conductive pattern part is formed be thicker than the oxide insulating film formed on a side surface of the coil conductive pattern part.

* * * * *